US006390197B1

(12) United States Patent
Maroy

(10) Patent No.: US 6,390,197 B1
(45) Date of Patent: May 21, 2002

(54) METHOD OF CEMENTING A WELL IN GEOLOGICAL ZONES CONTAINING SWELLING CLAYS OR MUD RESIDUES CONTAINING CLAYS

(75) Inventor: Pierre Maroy, Buc (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/554,707

(22) PCT Filed: Nov. 19, 1998

(86) PCT No.: PCT/EP98/07544

§ 371 Date: May 18, 2000

§ 102(e) Date: May 18, 2000

(87) PCT Pub. No.: WO99/27225

PCT Pub. Date: Jun. 3, 1999

(30) Foreign Application Priority Data

Nov. 26, 1997 (FR) ..... 97 14830

(51) Int. Cl.[7] ..... E21B 21/00; E21B 33/16; E21B 37/00; E21B 37/08

(52) U.S. Cl. ..... 166/291; 166/300; 166/312; 175/64; 507/240; 507/276; 507/277; 507/928

(58) Field of Search ..... 166/291, 292, 166/300, 312, 305.1; 175/64; 507/240, 269, 276, 277, 928

(56) References Cited

U.S. PATENT DOCUMENTS 2,252,669 A * 8/1941 Cross et al. ..... 175/64
2,761,843 A * 9/1956 Brown ..... 507/240
2,848,051 A * 8/1958 Williams ..... 166/291
3,022,823 A * 2/1962 Caldwell et al.
3,086,938 A * 4/1963 Means et al. ..... 507/240
3,149,684 A * 9/1964 Eckel et al. ..... 175/64 X
3,349,032 A * 10/1967 Krieg ..... 507/240 X
3,411,580 A * 11/1968 McKinney et al. ..... 166/312 X
3,653,441 A * 4/1972 Tuttle ..... 166/291
3,863,718 A * 2/1975 Bruist ..... 166/291 X
3,884,302 A * 5/1975 Messenger ..... 166/291
4,129,183 A * 12/1978 Kalfoglou ..... 166/300
4,141,843 A * 2/1979 Watson ..... 166/291 X
5,458,197 A * 10/1995 Chan ..... 166/312 X
5,501,276 A * 3/1996 Weaver et al. ..... 166/298
5,789,352 A * 8/1998 Carpenter et al. ..... 166/291 X

FOREIGN PATENT DOCUMENTS

GB 2073284 * 10/1981 ..... 166/291

* cited by examiner

*Primary Examiner*—George Suchfield
(74) *Attorney, Agent, or Firm*—Stephen F. Schlather

(57) ABSTRACT

Methods of treating wells for cementing operations and for improving placement of cement in wells containing water swelling clays include treatment of the well with a fluid containing clay precipitating agents capable of coagulating clays in the well. The coagulating fluid can contain quaternary ammonium salts, aqueous salts of potassium or cesium, or silicates as the clay coagulating agent. The coagulating fluids can be applied to convert soft mud cake into hard mud cake prior to placement of cement.

24 Claims, No Drawings

METHOD OF CEMENTING A WELL IN GEOLOGICAL ZONES CONTAINING SWELLING CLAYS OR MUD RESIDUES CONTAINING CLAYS

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to the field of services for the petroleum and related industries and in particular to techniques for constructing and repairing oil wells, gas wells, geothermal wells, and the like.

An oil well or the like is cemented, in particular to isolate the well from the various geological strata it passes through and to prevent fluids from migrating between the various geological strata or between the strata and the surface. Such isolation seeks in particular to prevent gases from rising towards the surface up the annular space surrounding the casing which serves to maintain well integrity. Another purpose of cementing is to avoid oil-bearing zones being invaded by brines, or to prevent reserves of fresh water being contaminated by oil or by brine. So-called "repair" cementing is generally for the purpose of re-establishing sealing that has been lost due to the primary cementing deteriorating.

Underground reservoirs, which may contain hydrocarbons, brine, fresh water, or other fluids, are very frequently isolated from one another by fine layers of compact, leakproof clay. To ensure that cementing re-establishes such sealing, it is of great importance that adhesion to the walls of the well should be very good without any cracks appearing.

While a well is being constructed, it is common practice to use a drilling mud that is stabilized by clays such as bentonite, for example. Mud is a slightly jelled fluid, it deposits on the walls and on centralizers, or, on porous walls, generally constituted by geological formations, it constitutes a mud or filter cake. Such cakes are compressible, and under the effect of pressure and of mud flow, they are transformed into a very compact layer which can itself constitute an acceptable interface between the underground formation and cement. Nevertheless, as the thickness of the mud cake increases, the porosity of the effective wall (cake plus geological formation) decreases and the cake which continues to be deposited becomes much less compact until it constitutes a "soft mud cake" made up of water-swollen clays. Cakes that are thick and soft tend to form in formations that are very permeable, such as unconsolidated coarse sands. Jelled mud deposits also occur in zones of low mud flow, e.g. level with centralizers, or, if the casing is off-center, in the narrower portion of the annulus between the casing and the underground formation.

Such soft cake is often the cause of subsequent leakage, and as a result efforts are made to eliminate it as much as possible. That is the function of cleaning fluids commonly known as "spacers" or as "chemical washes". As a general rule, such cleaning fluids contain detergents which clean the casing and the geological formations through which the borehole passes. The detergents are generally of the surface-active type adapted to the nature of the mud used, and in particular to the nature of the continuous phase of the mud (water or oil). They tend to favor swelling and dispersion of soft deposits so as to make them easier to eliminate by fluid flow.

When the geological formation contains clays, mud cake does not form in contact therewith because the clays are impermeable. As a result, the spacers cause the reactive clays of such formations to swell. "Cleaning" the well then becomes locally more harmful than favorable.

When cementing to repair sealing, even though the fluid preceding or following the cement is generally not mud, the problem is very similar. Clay-containing mud may have remained, and as a result of the presence of underground water, reactive clays will have swelled. The presence of swollen clays prior to cementing is bad for sealing since contact between cement and swollen clay is poor.

BRIEF SUMMARY OF THE INVENTION

The present invention improves placement of cement slurries in wells in geological zones containing swelling clays or mud residues containing clays. According to the invention, the well zone thought to contain water swelling clays is treated with a fluid containing clay precipitating agents capable of coagulating the clay prior to the cement slurry being put into place in the well during the cementing stage.

DETAILED DESCRIPTION OF THE INVENTION

An object of this invention is to improve the placement of cement slurry in the presence of reactive clays regardless of whether they come from the surrounding geological layers or from drilling mud.

The method of the present invention consists in treating the well or at least the zone of the well that may contain water-reactive clays, with a solution containing agents that precipitate the clays so as to coagulate them prior to putting the cement into place. The basic aim of the present invention is thus to convert the soft mud cake into a good hard mud cake before the cement slurry is placed and the cement sets, without any detrimental effect to the spacers/washes, nor to the cement slurry or to the cement. So, unlike cleaning treatments aiming at disintegrating and dispersing clays, the present invention aims at hardening the soft mud cake, the gelled mud patches and the swollen formation clays/shales.

The fluid for applying coagulation treatment to clays is preferably an aqueous solution containing hydrosoluble quaternary ammonium ions in the form of salts or hydroxides. Clays can also be precipitated using ions of potassium, rubidium, ammonium, cesium, or calcium, or indeed using silicates. In all cases, they are put into the solution in the form of soluble salts or hydroxides or in the form of a suspension, particularly in the case of calcium which can be provided in the form of a suspension of calcium hydroxide (lime water). One important aspect of the invention is the use of non-acidic fluid.

Several explanations for clay precipitation have been proposed. Amongst these explanations, we rely in particular on the hypothesis that ions pre-existing on the surface of clay platelets are replaced by ions from the treatment fluid, thereby causing water to be expelled and the "house of cards" of platelets to collapse.

The treatment fluid may contain one or more of the above-mentioned precipitating species. The concentration of the precipitating agent and the length of time it is in contact with the clay of the formation or the clay contained in the mud varies depending on the nature of the clay. Nevertheless, contact should not be for less than 10 seconds, and it is pointless to extend it beyond 20 minutes.

While setting, cement produces very large quantities of calcium ions. This production is moderate during the dormant period of the cement slurry, but it becomes very intense during hardening. When the cement slurry is left in contact with swelling clays, whether they come from mud or are contained in the formations, these ions diffuse into the clays. Unfortunately, it is well known that calcium ions coagulate swelling clays. Because the diffusion does not take place instantaneously and because calcium ions are produced mostly during the hardening of the cement, clay coagulation occurs when the cement is no longer movable. Cracks or channels are therefore formed where the cement comes into contact with the phases containing the swollen clays, thereby destroying the sealing provided by the cementing.

The present invention proposes "rinsing" wells or at least the sensitive zones of wells with a fluid that releases a large quantity of ions capable of coagulating clays before the calcium ions produced by the cement do so after the cement has hardened.

The present invention is applicable whenever cement is pumped and is made to flow to put it into place. The cement slurry may include numerous additives whether organic or inorganic to give it the particular properties required for the type of work. When pumping, e.g. in casing, tubing, or in coiled tubing, the slurry can be kept separate from the adjacent fluids either by wiper plugs, or by fluid "plugs" known as "spacers" or "chemical washes" in order to avoid mixing. In the annulus, the cement slurry can also be separated from adjacent fluids by spacers.

More precisely, the invention relates to placing a cement slurry in a well by pumping and circulating the slurry. The circulation can be performed by pumping the slurry into the casing from the surface. The slurry goes down inside the casing, round the "boot" at the bottom of the casing, and rises up the annulus between the casing and the borehole. Circulation can also be performed in the opposite direction, by pumping the slurry from the annulus towards the bottom of the well. This is less common, but it is done in particular when repairing the sealing of the layer of cement around the casing. It is also possible to pump the cement via the production tubing or via coiled tubing. The examples given of placement are not limiting.

The cement can then be isolated from the mud or the other fluids in the circular cylindrical portion of the run by wiper plugs.

Since the stage during which the well is cleaned by spacers or chemical washes leaves swollen clays, either elimination is not complete or there are swelling clays contained in the geological formations, and that makes the withdrawal of remaining clays worse. As a result, the treatment of the invention must always be performed after such a stage of cleaning the well, if one has taken place.

The invention is thus applicable whether or not spacers or chemical washes are used. A preferred use in primary cementing work, i.e. when mud is used, is together with spacers or chemical washes. These serve to eliminate mud as much as possible. The treatment fluid of the invention then coagulates any remaining mud prior to contact with the cement. The coagulating solution is placed between the spacers or chemical washes and the cement. In repair work, where mud is not used, it generally suffices to precede the cement with the treatment fluid for coagulating the reactive clays or the residual mud channels.

Lime water is difficult to handle on site and tends to become carbonated. Salts of calcium, and more particularly calcium chloride, have an accelerating effect on cement setting, and that may not be desirable. The same applies to silicates. In addition, they tend to form gels on contact with the cement slurry. Although potassium cesium salts can also be used in the invention, they tend with certain brands of cement to give rise to gels and are therefore of less universal application than quaternary ammonium ions which are more particularly preferred for their high power of coagulating clays and their small harmful influence on cement. Of hydrosoluble quaternary ammonium ions in the form of salts or hydroxides, those which are most particularly preferred for reasons of speed of action and of economy in use have the following form, i.e. quaternary ammonium with substituents R1, R2, R3, and R4 of the methyl to butyl type, or indeed unsaturated in C3 or C4, of the following type:

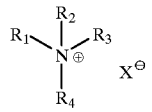

The anion may be mono- or multivalent, without emitting the $OH^-$ ion. For reasons of cost and availability, a chloride counter-ion is preferred.

With quaternary ammonium ions, the concentration in the precipitation fluid should be greater than 0.01 moles/liter (m/l), without any upper limit other than solubility. The preferred concentration range is 0.05 mA to 0.4 m/l.

With potassium or cesium ions, concentration in the precipitation fluid should be greater than 0.02 mA, without any upper limit other than solubility in water. Preferred concentrations lie in the range 0.1 m/l to 2 m/l.

With silicates, concentration in the precipitation fluid should lie in the range 0.1 m/l to 1 m/l, measured in terms of SiO4, and preferably in the range 0.3 m/l to 0.8 m/l, measured in terms of SiO4.

In addition to precipitating substances, the treatment fluid may contain weighting agents and other additives, such as surface active agents, suspension agents, dispersants, or indeed additives capable of retaining water in the treatment fluid to prevent dehydration thereof when it contains a large quantity of mineral particles as a weighting agent.

In particular, the surface active agents commonly used in chemical washes, and well known to the person skilled in the art, can be added to improve contact with mud, mud filter cake, or clayey formations, even with water muds. With oil muds, the advantage of adding surface active agents is clearly even greater.

At high pumping rates in small diameter wells, contact time can require volumes of precipitation fluid such that the height thereof in the well can disturb the hydrostatic equilibrium of the well. Under such circumstances, the precipitation fluid is weighted using methods well known to the person skilled in the art. This can be done by adding soluble salts (typically salts of calcium, cesium, or zinc), or by putting dense mineral particles of appropriate size into suspension.

The present invention applies particularly to primary cementing when the borehole passes through geological strata containing reactive clays or when very good sealing is desired, in particular because of the risk of gas migrating towards the surface.

I claim:

1. A method of treating a well containing at least one zone including water-swollen clay therein, the method comprising eliminating drilling fluid residues in the well by using a cleaning fluid in the well and then treating the well with a fluid containing clay precipitating agents so as to coagulate swollen clay and convert a soft mud cake formed by the swollen clay into a hard mud cake.

2. A method as claimed in claim 1, wherein the step of treating comprises placing the fluid in contact with the water swollen clay for a period of from about 10 seconds to about 20 minutes.

3. A method as claimed in claim 1, comprising using a coagulating fluid containing hydrosoluble quaternary ammonium salts as a coagulating agent.

4. A method as claimed in claim 3, comprising using a quaternary ammonium salt of the general formula:

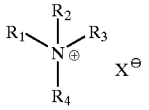

in Which $R_1$–$R_4$ are alkyl or allyl radicals of 1 to 4 carbon atoms, and $X^-$ is an anion.

5. A method as claimed in claim 4, comprising using a quaternary ammonium salt wherein R1–R4 are selected from the group consisting of methyl, butyl and unsaturated C3 and C4 radicals.

6. A method as claimed in claim 3, comprising using the quaternary ammonium salt at a concentration in the coagulating fluid of greater than 0.01 moles/liter.

7. A method as claimed in claim 6, comprising using the quaternary ammonium salt at a concentration in the coagulating fluid in the range 0.05–0.4 moles/liter.

8. A method as claimed in claim 4, comprising using the quaternary ammonium salt at a concentration in the coagulating fluid of greater than 0.01 moles/liter.

9. A method as claimed in claim 8, comprising using the quaternary ammonium salt at a concentration in the coagulating fluid in the range 0.05–0.4 moles/liter.

10. A method as claimed in claim 1, comprising using a coagulating fluid selected from the group consisting of aqueous solutions of potassium salts and aqueous solutions of cesium salts.

11. A method as claimed in claim 2, comprising using a coagulating fluid selected from the group consisting of aqueous solutions of potassium salts and aqueous solutions of cesium salts.

12. A method as claimed in claim 10, comprising using the aqueous salts at a concentration in the coagulating fluid of greater than 0.02 moles/liter of the aqueous salt.

13. A method as claimed in claim 12, comprising using the aqueous salt at a concentration in the coagulating fluid in the range of 0.1–2 moles/liter.

14. A method as claimed in claim 1, comprising using a coagulating fluid comprising silicates as a coagulation agent.

15. A method as claimed in claim 2, comprising using a coagulating fluid comprising silicates as a coagulation agent.

16. A method as claimed in claim 14, comprising using the silicate at a concentration in the coagulating fluid in the range 0.1–1 moles/liter, measured in terms of $SiO_4$.

17. A method as claimed in claim 16, comprising using the silicate at a concentration in the coagulating fluid in the range 0.3–0.8 moles/liter, measured in terms of $SiO_4$.

18. A method of treating a well containing at least one zone including water-swollen clay therein, the method comprising treating the well with a fluid containing silicates as clay precipitating agents so as to coagulate swollen clay and convert a soft mud cake formed by the swollen clay into a hard mud cake.

19. A method as claimed in claim 18, wherein the step of treating comprises placing the fluid in contact with the water swollen clay for a period of from about 10 seconds to about 20 minutes.

20. A method as claimed in claim 18, further comprising eliminating drilling fluid residues in the well by using a cleaning fluid in the well prior to treating with the fluid containing clay precipitating agents.

21. A method as claimed in claim 18, comprising using the silicate at a concentration in the coagulating fluid in the range 0.1–1 moles/liter, measured in terms of $SiO_4$.

22. A method as claimed in claim 21, comprising using the silicate at a concentration in the coagulating fluid in the range 0.3–0.8 moles/liter, measured in terms of $SiO_4$.

23. A method of cementing a well containing at least one zone including water-swollen clay therein, the method comprising:

(i) installing a casing in the well;

(ii) pumping into the well via the casing, a fluid containing clay precipitating agents so as to coagulate swollen clay and convert a soft mud cake formed by the swollen clay into a hard mud cake; and (iii) pumping a cement slurry into the well so as to fix the casing therein.

24. A method as claimed in claim 23, further comprising after installing the casing in the well and before pumping the coagulating fluid into the well, the step of pumping a wash fluid into the well to remove any drilling fluid residues therein.

* * * * *